United States Patent [19]

Muggleworth et al.

[11] Patent Number: 4,462,756

[45] Date of Patent: Jul. 31, 1984

[54] ROTOR FOR FLUID FLOW MACHINE

[75] Inventors: Simon D. Muggleworth, Bedfordshire; Colin G. Sparrow, Bristol, both of England

[73] Assignee: Rolls Royce Limited, London, England

[21] Appl. No.: 451,187

[22] Filed: Dec. 20, 1982

[30] Foreign Application Priority Data

Dec. 30, 1981 [GB] United Kingdom ..... 8139036

[51] Int. Cl.[3] ..... F01D 5/32

[52] U.S. Cl. ..... 416/215; 416/216; 416/217; 416/220 R

[58] Field of Search ..... 416/215, 216, 217, 220 R

[56] References Cited

U.S. PATENT DOCUMENTS

| | | | |
|---|---|---|---|
| 3,053,504 | 9/1962 | Shelley | 416/215 |
| 3,383,094 | 5/1968 | Diggs | 416/215 |
| 3,597,112 | 8/1971 | Garten | 416/215 |
| 3,902,824 | 9/1975 | Sauer | 416/215 |

*Primary Examiner*—Stephen Marcus
*Assistant Examiner*—John Kwon
*Attorney, Agent, or Firm*—Parkhurst & Oliff

[57] ABSTRACT

A filler member for a rotor of a turbomachine in which the rotor is of the type comprising a body provided with a peripheral groove. Each side of the groove has a flange which has a surface facing radially inwards. A circumferential array of blades, each of which has a root shaped to engage the inward facing surfaces of the flanges and is capable of sliding along the groove. At least one of the flanges has a first recess therein to enable the blades to be loaded into, and removed from the groove. The filler member comprises, a base portion extending along the groove below the roots of one or more of said blades and has at least one tab connected to the base portion extending outwardly therefrom. The tab is movable relative to the base portion between a first position in which the tab is clear of said first recess and thereby allows the filler member to move along the groove and a second position in which the tab is located in the recess and so prevents said filler member from moving along the groove. At least one second recess is defined in said filler member in which the root of one of the blades located to prevent them moving around the groove.

12 Claims, 7 Drawing Figures

Fig. 4.
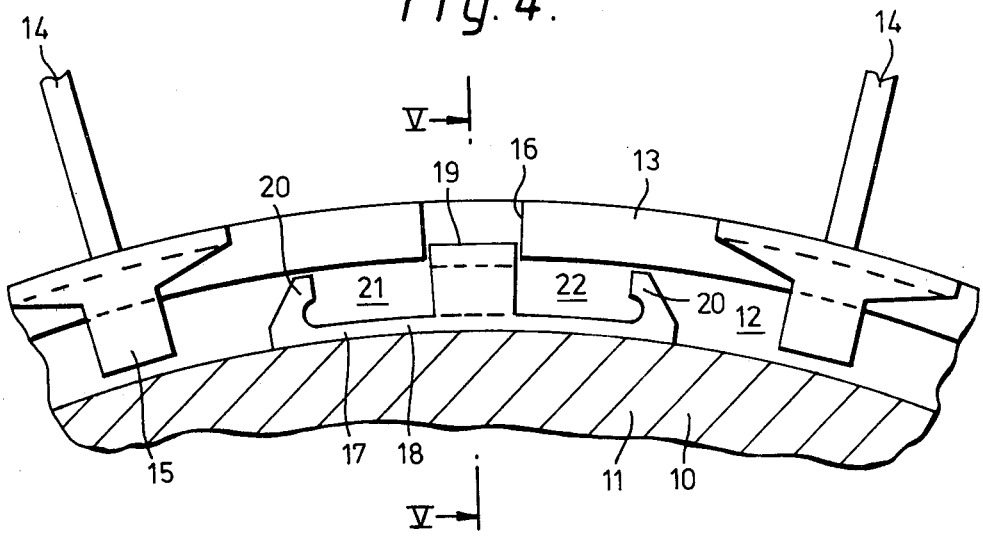
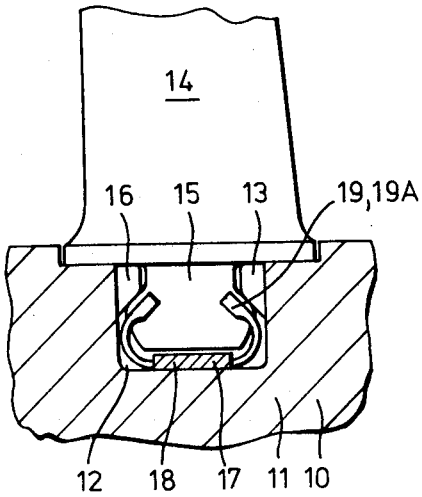
Fig. 5.
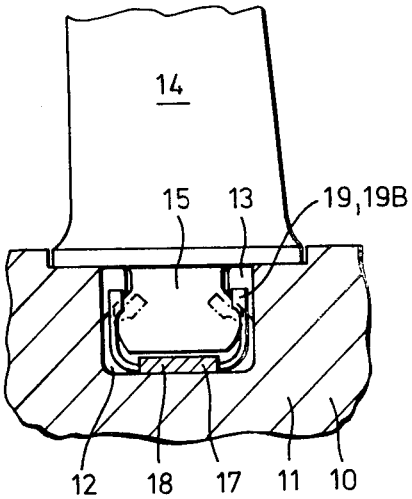
Fig. 3.

ROTOR FOR FLUID FLOW MACHINE

BACKGROUND OF THE INVENTION

This invention relates to a rotor for fluid flow machines, the rotor being of the kind comprising a rotor body having a peripheral groove, each side of the groove having a flange adjacent the top of the groove, an array of blades each having a root shaped to engage the groove under the respective flanges and to be slideable along the groove under the respective flanges and to be slideable along the groove, at least one of the flanges having a first recess to enable the blades to be sequentially inserted into and withdrawn from the groove, and a filler member for the first recess. Such a rotor will hereinafter be referred to as a rotor of the kind hereinbefore described.

It is known from U.K. Pat. No. 1,015,698 to provide in a rotor of the kind as hereinbefore described a filler member which is located in the groove and recesses beneath the blade platforms and has a screw member which can be threaded out of the filler member from the groove so as to engage the bottom of the groove and urge the filler member against the undersides of the blade platforms. However, such a filler member may in use become loose or may become bonded in position due to high operational temperatures.

It is also known from U.K. Pat. No. 1,187,227 to provide in a rotor of the kind hereinbefore described a filler member which is resilient and is pre-loaded before insertion so as after insertion to act on the circumferentially extending side walls of the recesses. However such a filler member, because it acts on the side walls of the recesses, imparts undesirable additional stress on the rotor.

It is an object of the invention to provide in a rotor of the kind hereinbefore described wherein the above disadvantages may be overcome.

SUMMARY OF THE INVENTION

According to this invention a filler member in a rotor of the kind hereinbefore described comprises a base portion extending along the groove below the roots of one or more of said blades; at least one tab connected to the base portion and extending outwardly therefrom, the tab being movable relative to the base portion between a first position in which the tab is clear of said first recess and said filler member is movable along the groove and a second position in which the tab is located in the recess and so prevents said filler member from moving along the groove; and at least one second recess defined in said filler member in which the root of one of the blades locates.

BRIEF DESCRIPTION OF THE DRAWING

Two filler members according to this invention will now be described, by way of example only, with reference to the accompanying drawings wherein:

FIG. 3 is a section on the line III—III in FIG. 1;

FIG. 4 is a view similar to FIG. 1 but showing a different stage in the assembly of the components;

FIG. 5 is a section on the line V—V in FIG. 4;

DETAILED DESCRIPTION OF PREFERRED EMBODIMENTS

Figure 1:
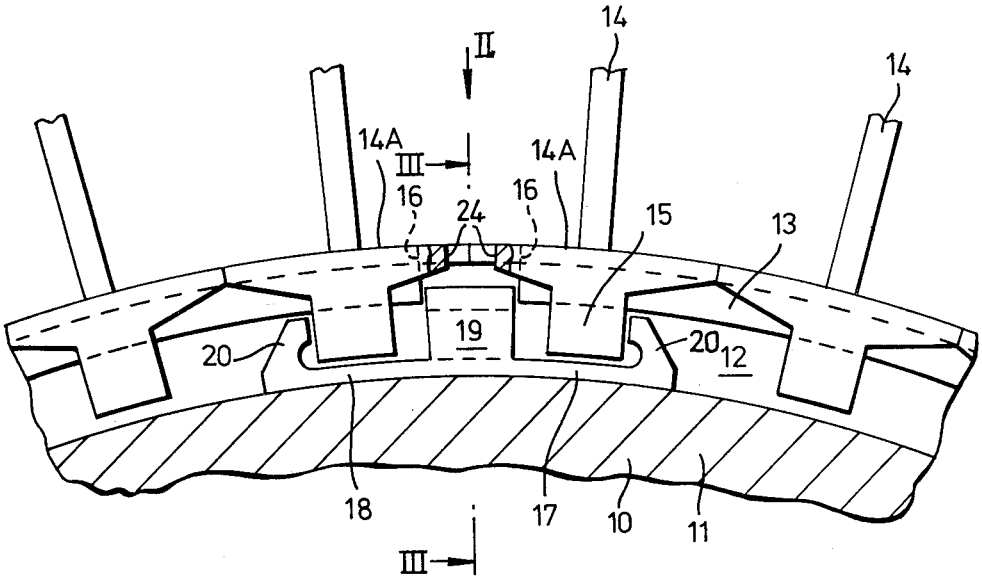
FIG. 1 is a sectional end view of a part of a first rotor carrying a first filler member.
Figure 2:
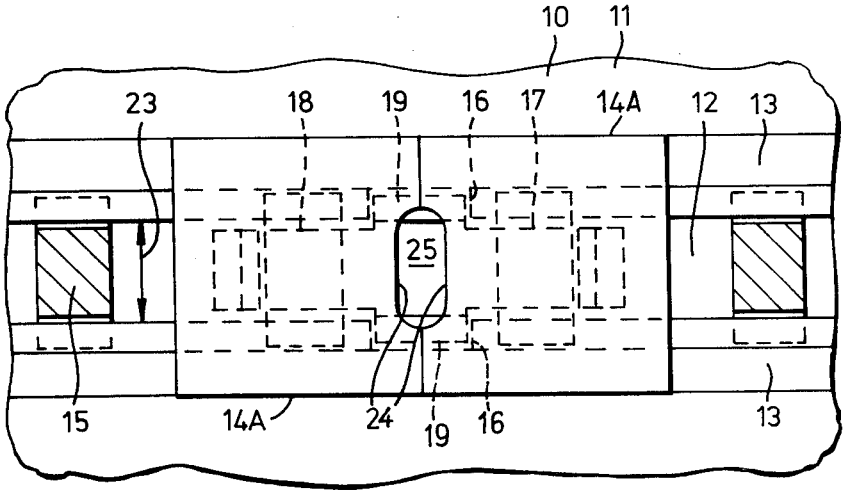
FIG. 2 is a view in the direction of the arrow II in FIG. 1.

Referring to FIGS. 1-3 the first rotor, denoted 10, comprises a rotor body 11 having in the circular periphery thereof a groove 12 extending completely around said periphery. The groove 12 is generally of dovetail cross-section and has at each side, and adjacent its top, a flange 13. The rotor further comprises an array of blades 14 each having a root 15 shaped to engage the groove 12 under the respective flanges 13, and the flanges retain the blades against the centrifugal force acting on them in operation. However, the blades are slideable along the groove 12 as may be required during their assembly on the body 11. The flanges each have a recess 16 through which the blades can be inserted into and withdrawn from the groove. Thus, when blades are to be inserted they are fed one after the other for their root to pass through the slot, and the blades already in the groove are moved along to make space for the insertion of any one next blade.

When all but the last two of the blades have been inserted in that way, this being the position shown in FIG. 4, a first filler member 17 is inserted through the recesses 16. The filler member comprises an elongate base 18 situated at the bottom of the groove 12. The base 18 is integral with two tabs 19 extending upwardly from the base at the respective sides thereof. The base also has at its ends upwardly extending portions 20; the portions 20 and the tabs 19 thus define therebetween recesses 21,22. The base itself is sufficiently narrow to be inserted through the gap 23 (FIG. 2) between the flanges 13 but the tabs are wider than the base and require the presence of the recesses 16 to enable the filler member to be inserted into the groove. As will be further explained below, when first inserted the tabs 19 clear the end sides of the flanges 13, allowing the filler member to move along the groove.

Next the filler member is slid along, say, clockwise as seen in FIG. 4, and the last but one blade is inserted through the recesses 16 in the flanges until the bottom of its root locates in the left hand recess 21 in the filler member 17. The filler member and the latter blade are then slid anti-clockwise to the extent of making it possible to insert the last blade through the recesses 16 in the flanges so that the root of that blade locates in the right hand recess 22 of the filler member. The filler member is then slid again clockwise until the tabs register with the recesses.

As shown in FIG. 5 the tabs have, at that stage, a lowered position 19A to enable them to clear the end sides of the flanges 13 during the movements right and left required for the insertion of the last two blades. However, when those movements have been completed and the tabs are again in register with the recesses, the tabs are bent up into a raised position 19B shown in FIGS. 1-3. In the raised positon the tabs are situated inside the respective recesses 16 and movement of the filler member along the groove is prevented thereby. Movement of the filler member out of the groove is prevented by the roots of the two blades situated directly above the base. Further, the upwardly extending portions 20 prevent movement of the last two blades, and therefore movement of all the blades, along the groove.

The last two blades each have a cut-out 24 in a platform part 14A of the blade, and the two cut-outs face one another and provide an opening 25 (FIG. 2) giving access to the tabs for the purpose of bending them into the raised position. This can easily be done by an appropriate hand tool. When the blades have to be removed from the groove the opening 25 again provides access for a tool whereby the tabs are bent back into the lowered position, and the above movements to the right and left of the filler member are then carried out in reverse to permit removal of the two blades adjacent the recesses 16, the removal of the filler member itself, and the sequential removal of the remaining blades.

Figure 6:
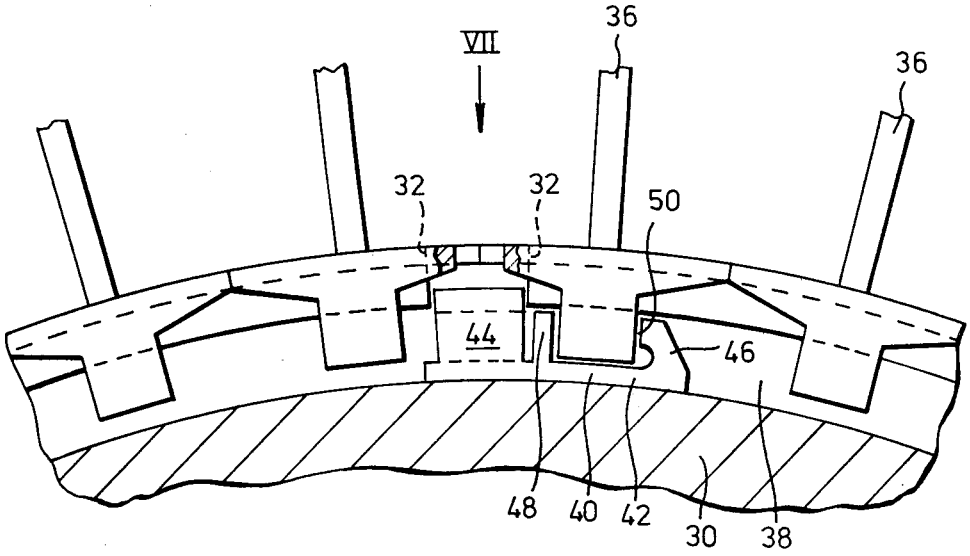
FIG. 6 is a sectional view, similar to that of FIG. 1, of a second rotor carrying a second filler member.
Figure 7:
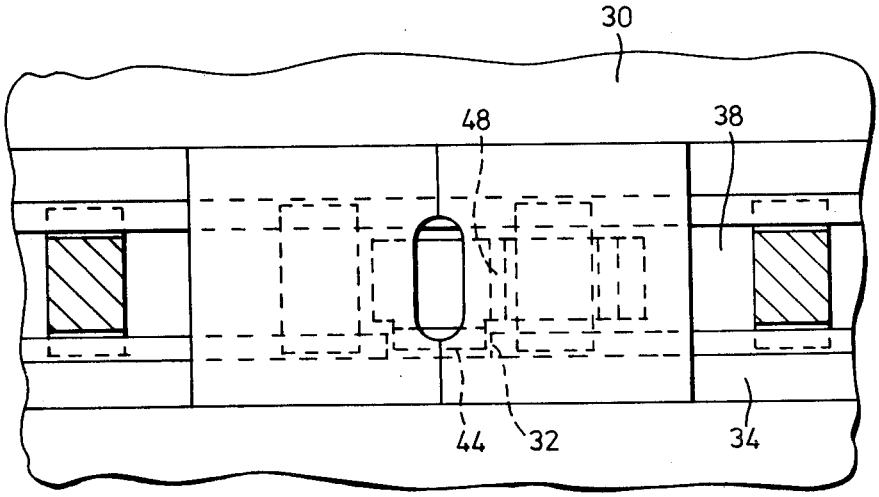
FIG. 7 is a view in the direction of the arrow VII in FIG. 6.

Referring to FIGS. 6 & 7, the second rotor 30 is similar to the first rotor 10 and will only be described insofar as to explain the differences therefrom. Whereas the rotor 10 has a recess 16 in each of its flanges 13 for insertion and removal of blades from its groove, the rotor 30 has a recess 32 in only its axially upstream flange 34 from insertion and removal of blades 36 from its groove 38. Such an arrangement may be used when a recess in the downstream flange (as in the first rotor 10) would produce an acceptable level of stress in the flange (the downstream flange working at a higher temperature than the upstream flange).

Blades 36 are inserted into the second rotor 30 in a similar way to that in the first rotor. All but the final two blades are inserted into the groove 38 through the recess 32. A second filler member 40, similar to the first filler member 17, is then inserted into the groove. The second filler member 40 comprises an elongate base 42 situated at the bottom of the groove 38. The base 42 is integral with a tab 44 extending upwardly from one side of the base. The base 42 has at its end remote from the tab 44 an upwardly extending portion 46 and also has an upwardly extending portion 48 between the tab 44 and the end portion 46. The portions 46 and 48 thus define therebetween a recess 50.

When the filler member 40 is first inserted, the tab 44 clears the end sides of the flange 34, allowing the filler member to move along the groove. Next the filler member is slid clockwise, as seen in FIG. 6, along the groove and the last but one blade is inserted into the groove through the recess 32. The filler member 40 and the latter blade are then moved anti-clockwise along the groove until the recess 50 in the filler member underlies the recess 32 in the flange. The final blade is then inserted through the recess 32, its root locating in the recess 50 in the filler member 40. The filler member and all the blades are moved clockwise until the tab 44 is in register with the recess 32. The tab 44 is then bent upwards (e.g. by an appropriate tool inserted as in the first rotor) to locate in the recess 32 and so prevent movement of the filler member and the blades along the groove 38. Movement of the filler member out of the groove is prevented by the base portion 42 extending under the root of the last inserted blade. If desired, the base portion 42 may be made also to extend under the root of the last but one inserted blade.

It will be appreciated that since the first filler member 17 has two recesses 21,22 in which are located the roots of adjacent blades, the size of the filler member is dictated by the spacing of the blades and their roots. This spacing may be different for different rows of blades at different axial positions in a machine, necessitating a different size of first filler member for each axial position in the machine. This may not be unacceptable.

It will also be appreciated that the above mentioned possible difficulty is obviated by the use of the second filler member since this locates the root of only one blade. The size of the second filler member is therefore independent of blade spacing and so the same size of second filler may be used at different axial positions in the machine having different blade spacings.

We claim:

1. A rotor assembly for a turbomachine comprising a rotor body having a circumferentially extending groove which is defined at least in part by two mutually confronting flanges, each of which has a surface facing substantially inwards, at least one of said flanges having a loading slot therein, a plurality of blades equispaced along said groove, each blade being retained in said groove by a complementary shaped root portion designed to engage the substantially inward facing surfaces of the two mutually confronting flanges, each root portion being shaped and dimensioned to enable said blade to be loaded into said groove through the loading slot and to be moved along said groove, and a filler member which locates in the loading slot and comprises an elongated base portion extending circumferentially along said groove below the root of at least one of said blades, said base portion being provided with at least one recess for securing the root of one of the blades and at least one tab connected to said base portion and extending outwardly therefrom, said tab being movable relative to said base portion between a first position in which said tab is clear of the loading slot and thereby allows said filler member to move along the groove and a second position in which said tab is located in the loading slot and so prevents said filler member from moving along said groove.

2. A filler member according to claim 1 wherein said recess is defined between a first outwardly extending portion at an end of said base portion and a second outwardly extending portion intermediate the ends of said base portion.

3. A filler member according to claim 2 wherein the second outwardly extending portion comprises the said tab.

4. A filler member according to claim 3 having two said recesses located one on either side of the at least one tab.

5. A filler member according to claim 4 wherein said rotor contains a said loading slot on each flange and the filler member has two tabs for location in their second positions in respective loading slots.

6. A filler member according to claim 3 wherein said rotor contains a said loading slot on each flange and the filler member has two tabs for location in their second positions in respective loading slots.

7. A filler member according to claim 2 having two said recesses located one on either side of the at least one tab.

8. A filler member according to claim 7 wherein said rotor contains a said loading slot on each flange and the filler member has two tabs for location in their second positions in respective loading slots.

9. A filler member according to claim 2 wherein said rotor contains a said loading slot on each flange and the filler member has two tabs for location in their second positions in respective first recesses.

10. A filler member according to claim 1 having two said recesses located one on either side of at least one of said tab.

11. A filler member according to claim 10 wherein said rotor contains a said loading slot on each flange and the filler member has two tabs for location in their second positions in respective loading slots.

12. A filler member according to claim 1, wherein said rotor contains a said loading slot on each flange and the filler member has two tabs for location in their second positions in respective first recesses.

* * * * *